US010098470B2

(12) United States Patent
Huang et al.

(10) Patent No.: US 10,098,470 B2
(45) Date of Patent: Oct. 16, 2018

(54) SOFA HAVING ADJUSTABLE BACKREST POSITION

(71) Applicant: LEGGETT & PLATT (JIAXING) CO., LTD., Zhejiang (CN)

(72) Inventors: Jinquan Huang, Jiaxing (CN); Liming Yang, Jiaxing (CN); Weiyao Zhou, Jiaxing (CN)

(73) Assignee: Leggett & Platt, Inc., South Gate, CA (US)

( * ) Notice: Subject to any disclaimer, the term of this patent is extended or adjusted under 35 U.S.C. 154(b) by 218 days.

(21) Appl. No.: 14/899,585

(22) PCT Filed: Jun. 19, 2014

(86) PCT No.: PCT/CN2014/080294

§ 371 (c)(1),
(2) Date: Feb. 26, 2016

(87) PCT Pub. No.: WO2014/202013

PCT Pub. Date: Dec. 24, 2014

(65) Prior Publication Data

US 2016/0174722 A1 Jun. 23, 2016

(30) Foreign Application Priority Data

Jun. 19, 2013 (CN) ..... 2013 1 0245287

(51) Int. Cl.

| | |
|---|---|
| ***A47C 17/04*** | (2006.01) |
| ***A47C 1/023*** | (2006.01) |
| ***A47C 17/86*** | (2006.01) |

(52) U.S. Cl.

CPC ..... *A47C 17/04* (2013.01); *A47C 1/023* (2013.01); *A47C 17/86* (2013.01)

(58) Field of Classification Search

CPC ..... A47C 17/04; A47C 1/023; A47C 17/86

(Continued)

(56) References Cited

U.S. PATENT DOCUMENTS 2,992,044 A * 7/1961 Johnson ..... A47C 21/006 297/219.1
5,645,318 A * 7/1997 Allison ..... B60N 2/072 248/430

(Continued)

FOREIGN PATENT DOCUMENTS

CN 101779872 A 7/2010
CN 102160716 A 8/2011

(Continued)

OTHER PUBLICATIONS

International Search Report dated Sep. 28, 2014 in Application No. PCT/CN2014/080294, 2 pages.

*Primary Examiner* — Syed A Islam
(74) *Attorney, Agent, or Firm* — Shook, Hardy & Bacon, LLP

(57) ABSTRACT

A sofa (1) having adjustable backrest position, and including a seat frame (10), a backrest frame (20), a guide-rail frame (30) and a driving device (40); the guide-rail frame (30) includes a guide-rail (300) which is fixedly connected to the seat frame (10) and which extends in the front-back direction of the sofa (1); a first end of a support frame (50) is connected to the backrest frame (20); a second end of the support frame (50) is connected to the guide-rail (300) so as to be able so slide relative thereto; the driving device (40) is arranged so as to be linked-motion connected to the support frame (50) in order to lead the second end of the support frame (50) to slide relative to the guide-rail (300).

15 Claims, 4 Drawing Sheets

(58) Field of Classification Search
USPC ..... 297/383, 283.3, 283.1
See application file for complete search history.

(56) References Cited

U.S. PATENT DOCUMENTS

| | | | | |
|---|---|---|---|---|
| 5,902,013 | A * | 5/1999 | Hong | A47C 1/023 248/429 |
| 7,073,854 | B2 * | 7/2006 | Tseng | B62J 1/28 297/215.1 |
| 7,387,338 | B2 * | 6/2008 | Beranek | B60N 2/203 297/283.3 |

FOREIGN PATENT DOCUMENTS

| | | | |
|---|---|---|---|
| CN | 203399866 | U | 1/2014 |
| DE | 202006016526 | U1 | 3/2007 |
| DE | 202009006801 | U1 | 9/2009 |
| EP | 1555005 | A2 | 7/2005 |

* cited by examiner

SOFA HAVING ADJUSTABLE BACKREST POSITION

CROSS-REFERENCE TO RELATED APPLICATIONS

This application claims priority under 35 U.S.C. § 365 to PCT/CN2014/080294, filed on Jun. 19, 2014, entitled "Sofa Having Adjustable Backrest Position," and Chinese Application No. 201310245287.X, filed Jun. 19, 2013, the entirety of the aforementioned applications are incorporated by reference herein.

FIELD OF THE INVENTION

The present invention relates to a seating facility, and more specifically to a sofa, and particularly to a sofa having a backrest of which the position is adjustable.

BACKGROUND OF THE INVENTION

The seat depth of a sofa (i.e. the distance from a backrest to a front edge of a sofa) desired by or suited for different people may vary because of difference in figure and seating angle of different individuals. Traditional sofas have a non-adjustable seat depth. People of large figure or petty figure may apparently feel uncomfortable when seating or reclining on the sofa with a non-adjustable seat depth.

Sofas with adjustable seat depth now have been seen in the market, but the seat depth of these sofas is usually adjusted in such a manner that the position of a backrest is adjusted to a preset position by tongue and groove engagement. The range of adjustable seat depth achieved by these sofas is very limited, and furthermore because of large size of the backrest, normally an average user may have difficulty in adjusting the position of the backrest. In addition, repeated dismounting or connection consequently may shorten life of these sofas.

Therefore, the present invention is intended to overcome one or more of the above defects.

SUMMARY OF THE INVENTION

An objective of the present invention is to provide a sofa of simple structure and long life, capable of continuously adjusting seat depth in an easy and convenient way.

The above objective is achieved by the following technical features: a sofa, having a backrest of which the position is adjustable, comprising a seat bracket, a backrest bracket, a guide rail rack and a drive means, wherein the guide rail rack includes a guide rail fixedly connected with the seat bracket and extending in a front-and-rear direction of the sofa, and a support bracket has a first end connected to the backrest bracket and a second end connected to the guide rail in a relatively sliding manner, the drive means being arranged to link with the support bracket in such a manner that the second end of the support bracket is guided to slide relative to the guide rail. The sofa according to the present invention can achieve continuous adjustment of the backrest bracket position by guiding the support bracket with the guide rail.

Preferably, the drive means is an electric motor which can be controlled easily such that adjustment of the backrest position can be operated by an average user more easily.

Preferably, the guide rail rack includes a front crossbeam and a rear crossbeam fixedly connected to the seat bracket, two ends of the guide rail being fixedly connected to the front crossbeam and the rear crossbeam respectively. The fixed connection between the guide rail rack and the seat bracket facilitates support of the backrest bracket during its movement, which makes the sofa durable.

Preferably, the second end of the support bracket is provided with a wheel, and the guide rail is provided with a groove in which the wheel may be disposed in a rollable manner. The cooperation between the wheel and the groove is called rolling cooperation with less friction, which enables the drive means to have less resistance during movement of the backrest position, so that the user can adjust the backrest position with ease or even without taking effort.

Preferably, the second end of the support bracket is provided with a connecting plate, at opposite sides of which wheels are arranged respectively, the guide rail having a pair of guide rail elements extending in parallel and each provided with a groove in a longitudinal direction for receiving corresponding wheels. The pair of guide rail elements allows the force applied onto the support bracket by the backrest bracket to be shared with the guide rail elements, such that stress received by the guide elements is reduced. In this case, the life of the sofa may be increased.

Preferably, the connecting plate is positioned in a gap between the pair of guide rail elements. By virtue of this configuration, the support bracket and the guide rail rack are mounted within a limited space of the seat bracket to make the overall structure more compact.

Preferably, in a preferred embodiment, the drive means is provided with a transmission device that transfers power to the second end of the support bracket. The transmission device is mounted in the gap between the pair of guide rail elements. This configuration is also advantageous in making the overall structure more compact.

Preferably, the first end of the support bracket is provided with a mounting plate in which mounting holes for detachable connection with the backrest bracket are disposed. By way of connecting the support bracket and the backrest detachably, the overall configuration of the sofa can be changed flexibly as needed. For instance, some sections of the sofa need a backrest while others don't, and in addition, the backrest can be dismounted to meet the requirement for cleaning or replacement.

Preferably, the sofa includes a plurality of guide rails and backrest brackets that are as many as the guide rails, such that the overall shape of the backrest of the sofa can be designed flexibly to make flexible variation of the backrest of the sofa become possible.

Preferably, the position of each of the backrest brackets can be adjusted synchronously by the same drive means or separately by different drive means. This configuration makes it possible to design the sofa more flexibly to meet diversified requirements of people in terms of comfort.

The sofa according to the present invention can realize adjustment of the backrest position in a simple and easy way as well as different seat depths by any adjustment of the backrest position. Besides, the sofa of the present invention has a simple and compact structure with fewer components and reduced friction between the components, so durability of the sofa is enhanced and life thereof is increased.

BRIEF DESCRIPTION OF THE DRAWING

The above and other features and advantages of the present invention will be more apparent from the illustration of the embodiments with reference to the drawings, in which.

DETAILED DESCRIPTION OF THE INVENTION

Figure 1:
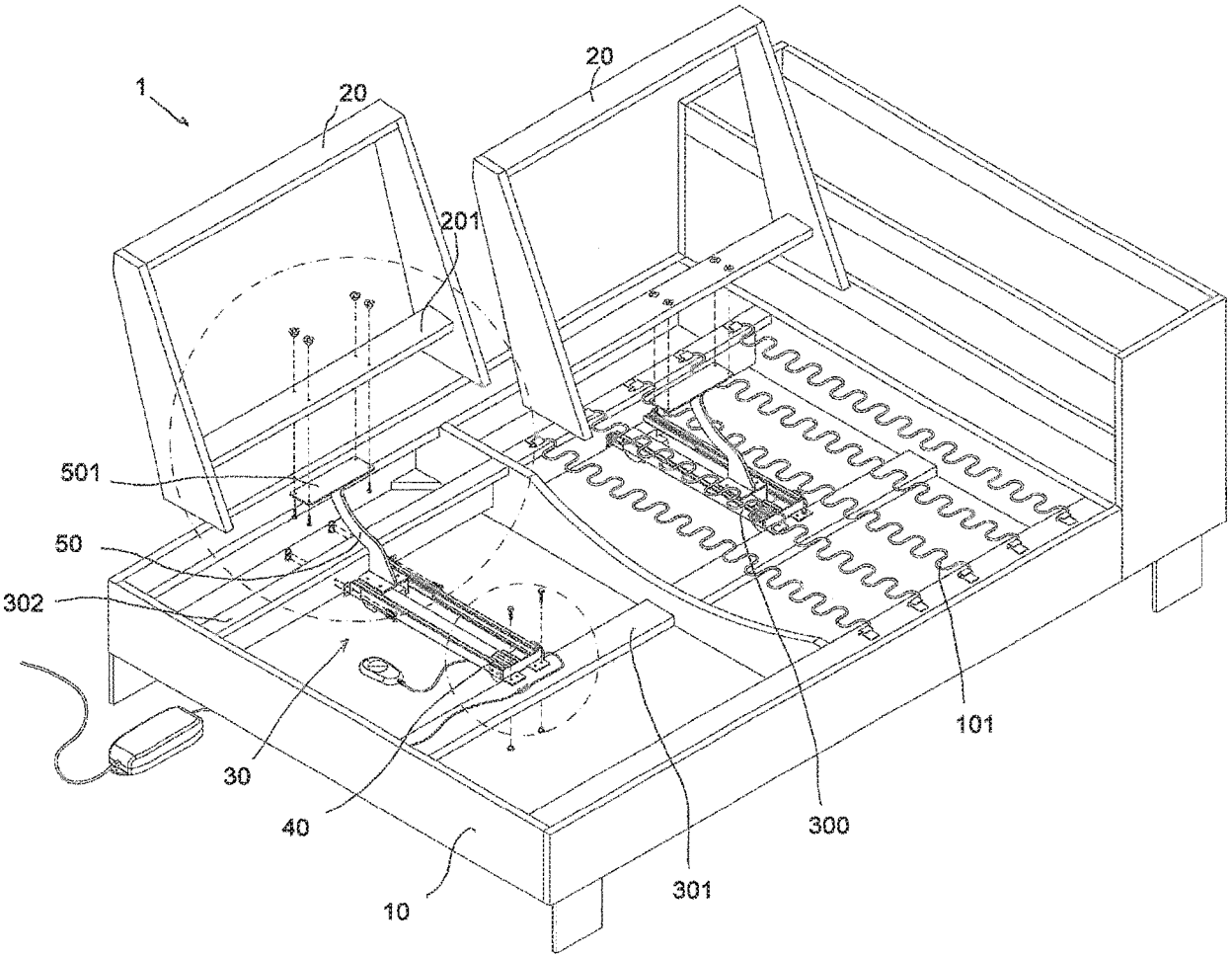
FIG. 1 shows a structural view of a main frame of the sofa according to one embodiment of the present invention.

Referring to FIG. 1, according to one embodiment of the present invention, a sofa 1, having a backrest of which the position is adjustable, comprises a seat bracket 10, a backrest bracket 20, a guide rail rack 30 and a drive means 40. The seat bracket 10 is constructed as a main frame for supporting a sofa seating face structure which is a primary component of the sofa for receiving force. Generally, the seating face structure of a sofa comprises types of rubber band, flat wood sheet, serpentine steel spring and so on. At present, sofas on the market are mostly formed to have a bottom of medium density fiberboard as a seating face structure on which a medium density sponge and a polyester wadding are laid in layers to enhance comfortable feeling. The seating face structure shown in FIG. 1 is a serpentine steel spring structure 101. The backrest bracket 20 is used to support back of an occupant when seated on the sofa. Thus, the backrest bracket 20 is disposed at a distance from a front edge of the seat bracket 10 in a front-and-rear direction of the sofa to leave certain space for seating. The guide rail rack 30 for adjusting the backrest bracket position therefore is arranged in a substantially rear half section of the seat bracket 10, as shown in FIG. 1. The guide rail rack 30 includes a guide rail 300 for guiding the backrest bracket 20 to move. The guide rail 300 extends in the front-and-rear direction of the sofa and includes a front crossbeam 301 and a rear crossbeam 302 fixedly connected to the seat bracket 10 as shown in the embodiment, two ends of the guide rail 300 being fixedly connected to the front crossbeam 301 and the rear crossbeam 302 respectively.

The terms "front" and "rear" are used to mean that in a static state of a sofa placed horizontally and ready for use, and generally speaking when an occupant seats on the sofa, an edge close to the legs of the occupant is a front edge of the sofa while an edge close to the back of the occupant is a rear edge. A distance between the front edge and the rear edge in the front-and-rear direction of the sofa is referred to as a depth of the sofa, and a distance from the front edge to the backrest in the front-and-rear direction of the sofa is referred to as a seat depth. A widthwise direction of the sofa refers to a direction perpendicular to the front-and-rear direction of the sofa and parallel with a horizontal plane.

Broadly speaking, the term "sofa" herein shall be understood as a seating facility or chair having the same function as a seat, or even include a bed having a backrest or frame. The term "backrest" shall not be limited to the frame of a sofa for supporting the back of an occupant, but instead may be construed as a boundary frame for defining a seating face width or depth of the sofa, e.g. left and right armrest of the sofa.

As shown in FIG. 1, the backrest bracket 20 is connected to the guide rail rack 30 via a support bracket 50. The backrest bracket 20 is a separate frame structure which is detachably connected to a first end of the support bracket 50 by fasteners such as bolts. The support bracket 50 in the drawing is configured as a bar of a rectangular cross section with a bent part. Those skilled in the art may envisage that the support bracket 50 may be designed to have a cross section of any shape and a profile of any shape. In the specific embodiment shown in the drawing, the first end of the support bracket 50 is provided with a mounting plate 501, and the backrest bracket 20 is accordingly provided with a mounting member 201 extending in a widthwise direction of the sofa. The mounting holes in the mounting plate 501 and the mounting holes in the mounting member 201 are aligned with each other, through which the fasteners such as bolts pass to fixedly connect the backrest bracket 20 and the support bracket 50. A second end of the support bracket 50 is cooperated and connected with the guide rail 300 in the guide rail rack 30 in a movable manner. In the embodiments shown in FIGS. 2 and 3, the support bracket 50 is arranged in an inclined manner relative to the plane where the guide rail 300 lies in.

Figure 2:
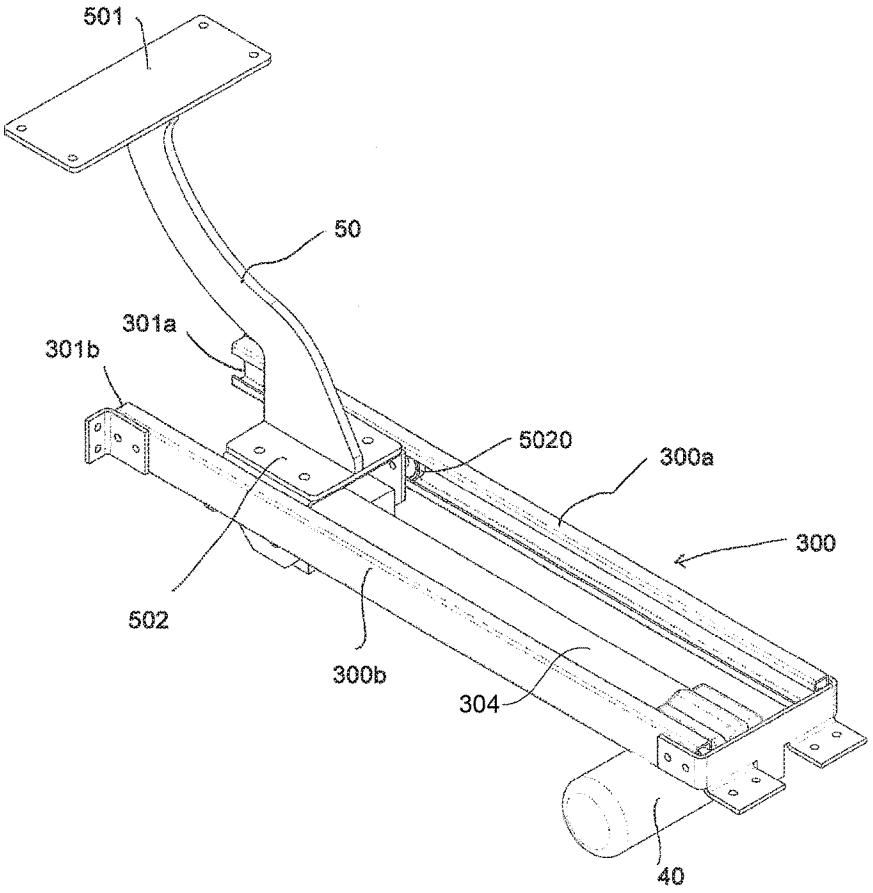
FIG. 2 shows a support bracket and a guide rail rack of a sofa in a first seat depth position, wherein the front and rear crossbeams of the guide rail rack are not shown for the sake of clarity.
Figure 3:
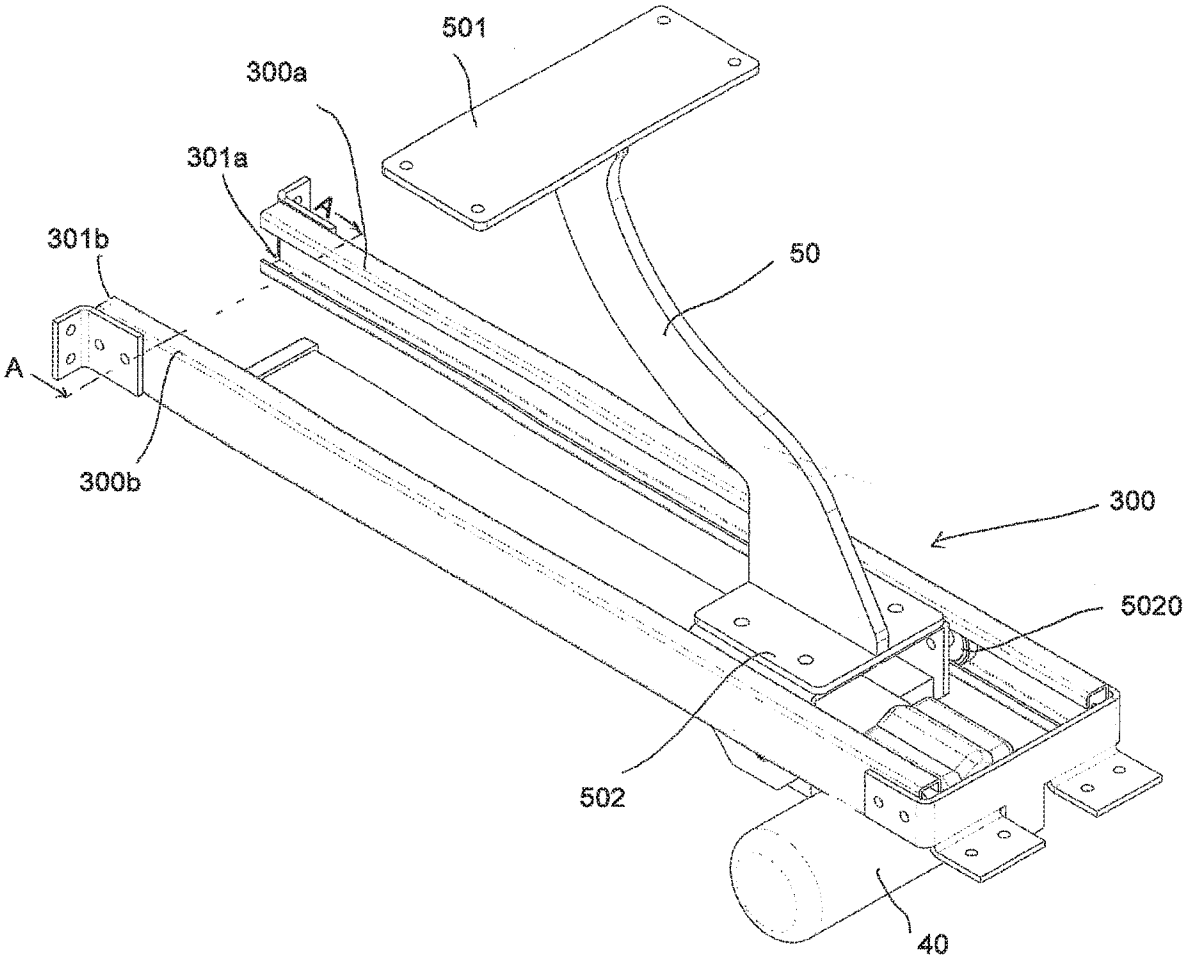
FIG. 3 shows a support bracket and a guide rail rack of a sofa in a second seat depth position.

Specifically, referring to FIGS. 2 and 3, the guide rail 300 has a pair of guide rail elements 300*a*, 300*b* extending in parallel, and the second end of the support bracket 50 is positioned in a gap between the pair of guide rail elements and connected in a relatively slidable manner to the guide rail elements 300*a*, 300*b* at both sides thereof. The second end of the support bracket 50, as shown in the embodiments of the drawings, is provided with a connecting plate 502 of a reversed U-shaped cross section, to outer sides of two legs of which wheels 5020 protruding outward are fixedly connected, the wheels 5020 extending into grooves 301*a*, 301*b* formed in the guide rail elements 300*a*, 300*b* and extending in a longitudinal direction of the guide rail. The wheels 5020 may roll in respective grooves. Preferably, opening widths of the grooves are smaller than diameters of the wheels so that the wheels are restricted in the grooves without disengaging therefrom during a stroke of the wheels. The second end of the support bracket 50, guided by the guide rail 300, is movable back and forth in an extension direction of the guide rail. That is, the backrest bracket 20 fixedly connected to the support bracket 50 is movable in a front and rear direction of the sofa to obtain different seat depths of the sofa.

Figure 4:
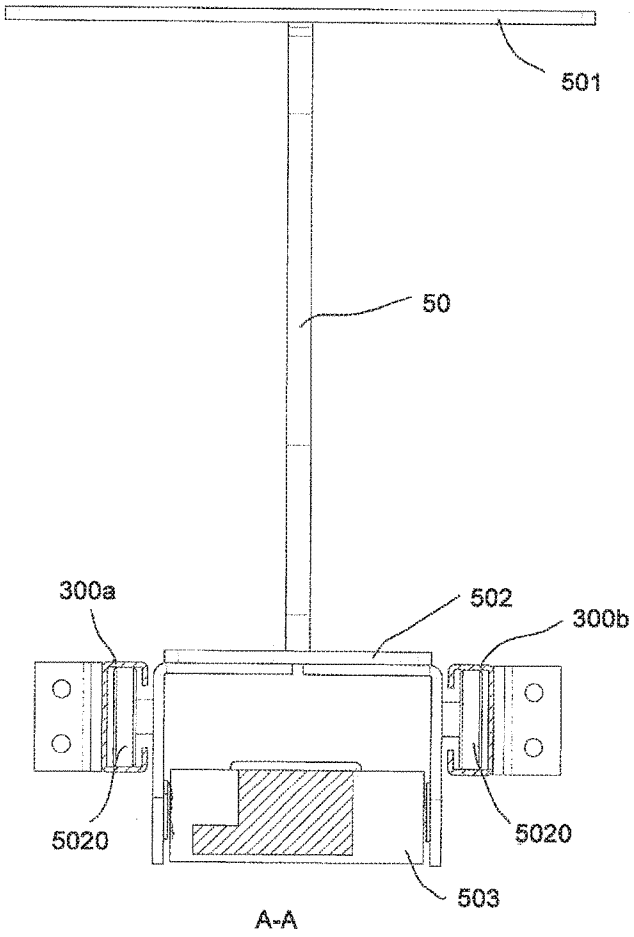
FIG. 4 is a sectional view obtained along the line A-A of FIG. 3.

Referring to FIG. 4, in a recessed space defined by the reversed U-shaped connecting plate 502, a slider 503 fixedly connected thereto is arranged. The drive means 40, e.g. electric motor, drives the slider 503 by means of a transmission device, e.g. a push rod 304 (best seen in FIG. 2), to slide in the extension direction of the guide rail, whereby the connecting plate 502 fixedly connected to the slider 503 and thus the support bracket 50 and the backrest bracket 20 are brought to move in the front-and-rear direction of the sofa, such that the seat depth of the sofa can be adjusted continuously. In the embodiments shown in the drawings, the transmission device, e.g. push rod 304, can be mounted in a gap between the paired guide rail elements to make full use of a limited mounting space.

In the embodiment of the drive means that is an electric motor, rotation of the electric motor in a positive/negative direction can be achieved by a control switch of the electric motor to move the slider backward/forward. Further, when the electric machine stops rotation, the position of the slider is locked and thus the position of the backrest bracket 20 is locked, to prevent the backrest bracket from sliding when a backward push force from the back of an occupant is applied to the backrest bracket. The control of the electric motor is relatively easy and can be done by a few control buttons and corresponding control circuits, so operation thereof exhibits remarkable advantage compared with traditional manual control. Moreover, because of continuity of the guide rail, there is no resistance against movement of the backrest bracket within its allowed stroke range, and hence the backrest bracket exhibits enhanced capacity of continuous adjustment. In addition, considering that small space is required for mounting the electric motor, those skilled in the art, attempting to achieve a compact design structure, may mount the electric motor in a lower region of the seat bracket or on the guide rail rack. Further, the transmission device may be mounted on the guide rail rack. In terms of appearance, the aesthetic of the sofa will not be affected by mounting of the electric motor and the guide rail rack because a finally formed sofa is covered with a filling pad over the seat bracket. Although the drive means in the drawings is an electric motor, those skilled in the art may envisage using any means capable of converting energy such as electrical energy or mechanical energy into mechanical power as output, e.g. hydraulic drive means, to replace the electric motor.

Although the cooperation between the second end of the support bracket 50 and the guide rail 30 is achieved by rolling the wheels in the groove, those skilled in the art may envisage that the cooperation therebetween can be realized by sliding cooperation between an inner surface of the guide rail groove and a bulge designed to extend into the groove. Also, those skilled in the art may envisage that the reverse U-shaped connecting plate may be designed to have enough span across the pair of guide rail elements, and on inner sides of the legs of the reverse U-shaped connecting plate there are bulges which cooperates with the grooves respectively open in opposite directions in the guide rail elements of the pair. In an alternative embodiment, a leg side of the reverse U-shaped connecting plate may be designed to have a groove, and in the guide rail element arranged opposite thereto, a protruding strip or roller is formed for cooperating with the groove. Therefore, a cooperating structure between the second end of the support bracket and the guide rail includes but is not limited to the illustrated wheel-groove structure, but may be embodied as any cooperating structure of complementary/interlocking shape, capable of achieving the guide function through relative sliding.

The sofa shown in the drawings has two backrest brackets 20 and corresponding support brackets and guide rails, but those skilled in the art may envisage that the number of the backrest brackets is not limited to the illustrated number, but may be e.g. one, three or more. Accordingly, the number of the guide rails and the support brackets may vary. The position of these backrest brackets may be adjusted synchronously by the same drive means or separately by different drive means to meet diversified and individualized requirements.

Those skilled in the art may envisage that when the seat depth is adjusted to a position wide enough, the sofa has an additional function for reclining, rather than a function of seating alone. In this case, the backrest bracket position is adjusted to change the depth of the sofa to meet different reclining requirements.

Of course, the structure for adjusting the backrest position disclosed in the present invention may be applied to adjustment of left and right armrest positions of a sofa, backrest position of a chair, bedside table position of a bed and so on. Various seating facilities, including sofa, chair, bed and so on, may benefit from the structure disclosed herein for adjusting the backrest position.

The above depiction is on only preferred embodiments of the present invention and is not taken as limiting or restricting this invention since various modifications and variations may be made without departing from the scope of the present invention through the exercise of those skilled in the art. Other embodiments may be obtained on the basis of disclosure in the description. The description and embodiments shall be considered exemplary only and the true scope of the invention is defined by the annexed claims and equivalents thereof.

LIST OF REFERENCE NUMBERS

1—Sofa;
10—seat bracket;
20—backrest bracket;
201—mounting member;
30—guide rail rack;
300—guide rail;
300*a*, 300*b*—guide rail elements;
301*a*, 301*b*—grooves;
301—front crossbeam;
302—rear crossbeam;
40—drive means;
101—serpentine steel spring structure;
50—support bracket;
501—mounting plate;
502—connecting plate;
5020—wheel;
503—slider

What is claimed is:

1. A sofa, having a backrest of which the position is adjustable, comprising:

a seat bracket;

a pair of guide rails connected to the seat bracket, each guide rail of the pair of guide rails extending in a front-and-rear direction of the sofa;

a slider configured to engage and travel along each guide rail of the pair of guide rails;

a support bracket having a first end opposite a second end, the second end coupled to the slider;

a backrest bracket connected to the first end of the support bracket such that the backrest bracket moves independently relative to the seat bracket in response to the slider moving in the front-and-rear direction of the sofa; and an electric motor configured to actuate a push rod between an extended position and a retracted position, the push rod attached to the slider and configured to move the slider along each guide rail of the pair of guide rails in the front-and-rear direction of the sofa.

2. The sofa according to claim 1, further comprising:

a front crossbeam and a rear crossbeam, each crossbeam being fixedly connected to the seat bracket;

each guide rail of the pair of guide rails having a forward end opposite a rearward end, the forward end of each guide rail being fixedly connected to the front crossbeam and the rearward end of each guide rail being fixedly connected to the rear crossbeam respectively.

3. The sofa according to claim 1, wherein the second end of the support bracket is fixedly attached to the slider.

4. The sofa according to claim 1, further comprising:

a U-shaped connecting plate, wherein the second end of the support bracket is connected to the U-shaped connecting plate; and a first wheel and a second wheel operatively coupled to the U-shaped connecting plate, wherein each guide rail of the pair of guide rails includes a groove extending in the front-and-rear direction and configured to receive one of said wheels, wherein the U-shaped connecting plate is affixed to the slider.

5. The sofa according to claim 4, wherein the first connecting plate and the second connecting plate are positioned in a gap between the pair of guide rails.

6. The sofa according to claim 1, characterized in that the first end of the support bracket is provided with a mounting plate in which mounting holes for detachable connection with the backrest bracket are disposed.

7. A sofa, having at least two independent backrest portions, of which the positions are adjustable relative to a common seat portion, the sofa comprising:

a seat bracket;

a first backrest bracket movably coupled to the seat bracket such that the first backrest bracket is adjustably movable relative to the seat bracket, the coupling between the first backrest bracket and the seat bracket comprising:

(1) a first pair of guide rails connected to the seat bracket and extending in a front-and-rear direction of the sofa;

(2) a first slider configured to engage and travel along each guide rail of the first pair of guide rails;

(3) a first support bracket carried on the first slider; and (4) the first backrest bracket attached to the first support bracket opposite the first slider;

a second backrest bracket movably coupled to the seat bracket such that the first backrest bracket is adjustably movable relative to the seat bracket, the coupling between the second backrest bracket and the seat bracket comprising:

(1) a second pair of guide rails connected to the seat bracket and extending in a front-and-rear direction of the sofa;

(2) a second slider configured to engage and travel along each guide rail of the second pair of guide rails;

(3) a second support bracket carried on the second slider; and (4) the second backrest bracket attached to the second support bracket opposite the second slider; and a first motor configured to drive at least one of the first slider along the first pair of guide rails or the second slider along the second pair of guide rails in the front-and-rear direction.

8. The sofa according to claim 7, wherein the first motor is configured to move the first back bracket and the second back bracket simultaneously.

9. The sofa according to claim 7, wherein the first motor is configured to drive the first slider along the first pair of guide rails, the sofa further comprising:

a second motor configured to drive the second slider along the second pair of guide rails in the front-and-rear direction.

10. The sofa according to claim 9, wherein the first motor and the second motor are configured to synchronously drive the first slider and the second slider.

11. The sofa according to claim 7, wherein a first support bracket second end is attached to a first U-shaped connecting plate and the first U-shaped connecting plate is attached to the first slider, wherein a second support bracket second end is attached to a second U-shaped connecting plate and the second U-shaped connecting plate is attached to the second slider.

12. The sofa according to claim 11, wherein each of the first U-shaped connecting plate and the second U-shaped connecting plate have a substantially horizontal portion between a right vertical portion and a left vertical portion, the first support bracket second end is connected to the substantially horizontal portion of the first U-shaped connecting plate and the second support bracket second end is connected to the substantially horizontal portion of the second U-shaped connecting plate.

13. The sofa according to claim 12, wherein the right vertical portion of each of the first U-shaped connecting plate and the second U-shaped connecting plate have a respective right wheel rotatably connected thereto, wherein the left vertical portion of each of the first U-shaped connecting plate and the second U-shaped connecting plate have a respective left wheel rotatably connected thereto.

14. The sofa according to claim 7, wherein the first motor is configured to drive the first slider along the first pair of guide rails, the sofa further comprising:

a push rod operatively coupled to the first motor, wherein the first motor is configured to actuate the push rod between an extended position and a retracted position;

the push rod attached to the first slider and configured to move the first slider along the first pair of guide rails in the front-and-rear direction of the sofa.

15. The sofa according to claim 14, wherein the first push rod is positioned in a gap between the first pair of guide rails.

* * * * *